United States Patent [19]

Stevens

[11] Patent Number: 4,795,397

[45] Date of Patent: Jan. 3, 1989

[54] TWIN

[76] Inventor: Betty B. Stevens, 108 N. Creek, Bartlesville, Okla. 74003

[21] Appl. No.: 9,933

[22] Filed: Feb. 2, 1987

[51] Int. Cl.[4] ..... A63H 3/02; A63H 3/36

[52] U.S. Cl. ..... 446/320; 446/369; 446/390; 434/155

[58] Field of Search ..... 446/268, 320, 295, 296, 446/369, 390, 391; 434/155

[56] References Cited

U.S. PATENT DOCUMENTS

| | | | |
|---|---|---|---|
| 833,448 | 10/1906 | Vall et al. | 446/391 |
| 1,558,278 | 10/1925 | Phillips | 446/295 |
| 2,199,049 | 4/1940 | Greenberg | 446/320 |
| 3,026,648 | 3/1962 | Lemelson | 446/391 |
| 3,783,553 | 1/1974 | Goozner | 446/372 |
| 3,828,467 | 8/1974 | Kaelin | 446/320 |
| 4,197,670 | 4/1980 | Cox | 446/369 |
| 4,259,807 | 4/1981 | Silverstein | 446/320 |
| 4,575,351 | 3/1986 | Gonzalez | 446/369 |
| 4,622,021 | 11/1986 | Darrigo | 446/320 |
| 4,659,319 | 4/1987 | Blair | 446/391 |
| 4,715,842 | 12/1987 | Noble | 446/268 |

FOREIGN PATENT DOCUMENTS

| | | | |
|---|---|---|---|
| 2537801 | 3/1976 | Fed. Rep. of Germany | 446/391 |
| 63186 | 6/1913 | Switzerland | 446/391 |
| 22825 | of 1909 | United Kingdom | 446/391 |
| 2041771 | 9/1980 | United Kingdom | 446/320 |
| 2110098 | 6/1983 | United Kingdom | 446/369 |

OTHER PUBLICATIONS

Patner, Myra M., The Washington Post, "Sewing Up the Doll Market", Dec. 6, 1984, p. B5.

Coleco, 1987, Toy Catalog, pp. 8–9.

*Primary Examiner*—Robert A. Hafer

*Assistant Examiner*—Charles H. Harris

*Attorney, Agent, or Firm*—Head & Johnson

[57] ABSTRACT

The doll is considered a "Twin" for a child. It is a method for making a twin doll for a newborn child in which the newborn child has vital statistics including the name, date of birth, weight, length, handprints and footprints. The doll is constructed to have the exact length of the newborn child and to have the exact weight of the newborn child. The imprints of the newborn child are placed on the palm of the hands and the sole of the feet of the doll. The weight, length and imprints remain fixed and the doll is indeed a "replica" of the newborn child. Vital statistics including date of birth and name are also inscribed on the doll.

4 Claims, 3 Drawing Sheets

NAME -- _____
DATE -- _____
HAIR -- _____
EYES -- _____
WEIGHT -- _____
LENGTH -- _____
PLACE OF BIRTH -- _____
BLOOD TYPE -- _____
36
Fig. 5
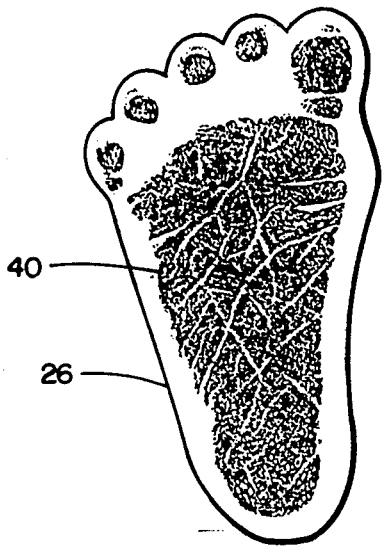
Fig. 3
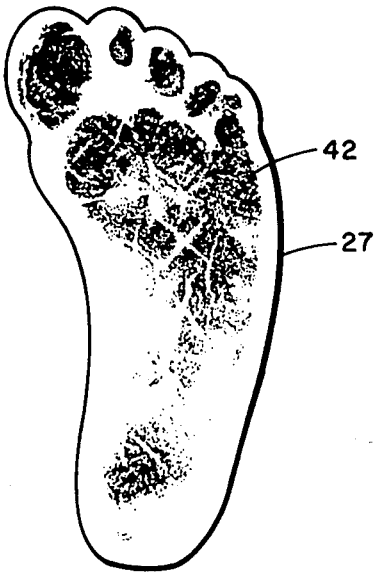
Fig. 4

TWIN

DISCLOSURE STATEMENT

A preliminary patentability search conducted for the inventor listed the following U.S. Pat. Nos.:

558,014 Elborne
659,910 Baldwin
936,344 Myers
1,246,753 Taylor
1,412,171 Duberstein
2,199,049 Greenberg
2,640,287 Lacoursiere
2,754,121 Jupiter
3,729,865 Naunheim
3,861,078 Snyder
4,196,521 Hutchinson et al
4,259,807 Silverstein
4,323,234 Glaese U.S. Pat. No. 4,259,807, Silverstein, shows arms and legs adjustably attached to the trunks with the size of the doll being adjusted. U.S. Pat. No. 3,729,869, Naunheim, relates to a stuffed jointed doll with mirror face. U.S. Pat. No. 2,199,049, Greenburg describes a doll wherein the face can be changed from time to time to afford a different facial expression. U.S. Pat. No. 3,861,078, Snyder which reveals a doll having a face that can be removed to expose a reflective surface such as a mirror.

U.S. Pat. No. 2,754,121, Jupiter is a dancing doll but is not considered pertinent.

The other patents are not considered pertinent but are included herein because they do show various means for measuring height, height of jump, reach and various indicia.

BACKGROUND OF THE INVENTION

This invention relates generally to dolls such as played with by children.

Children's dolls have been generally of a size that are smaller than the child who plays with it and the little child usually pretends to be the big mother of the little doll by taking care of its needs. Some dolls are made of a size that can be regarded as a companion or a friend of the child.

SUMMARY OF THE INVENTION

The doll of this invention can be considered to be "The Twin" TM doll of the child to whom the doll is to be given. Each doll will be designed for a specific child to match certain statistics of the child when born. The Twin Doll TM doll will have a weight added as needed so that the doll equals the weight of the newborn child. This weight adjustment can be obtained by having a closable opening in the back of the doll body so that the appropriate weight can bee added to a receptacle within the doll body itself. Then the opening can be reclosed. Means are also provided for adjusting the length of the doll lying down so that its length can be adjusted to be the same as the length of the child when born. Thus, the doll becomes a "twin" to the newborn babe.

The chest of the body of the doll is provided with a statistical display surface. Vital statistics of the newborn babe for which the doll is to be a "twin" is placed on this display surface. This includes name, date of birth, color of hair, color of eyes, the weight, length, place of birth and blood type.

In order to make the doll even more of a "twin" to the newborn babe, the footprints and handprint of the newborn babe can be imprinted respectively on the bottom of the foot and palm of the hand of the doll.

It is thus an object of the present invention to provide a doll which is a "twin" in many respects to a newborn baby to whom the doll is to be given.

BRIEF DESCRIPTION OF THE DRAWINGS

FIG. 3 illustrates the sole of the right foot.
FIG. 4 illustrates the sole of the left foot.
FIG. 5 illustrates a statistical display surface which is to be placed on the chest of the doll.

DETAILED DESCRIPTION OF THE INVENTION

Figure 2:
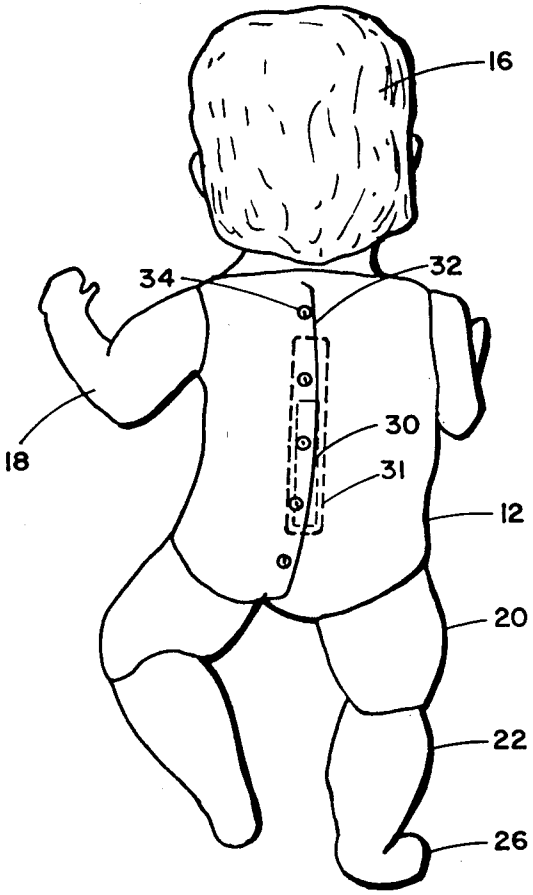
FIG. 2 illustrates the back side of the doll.
Figure 1:
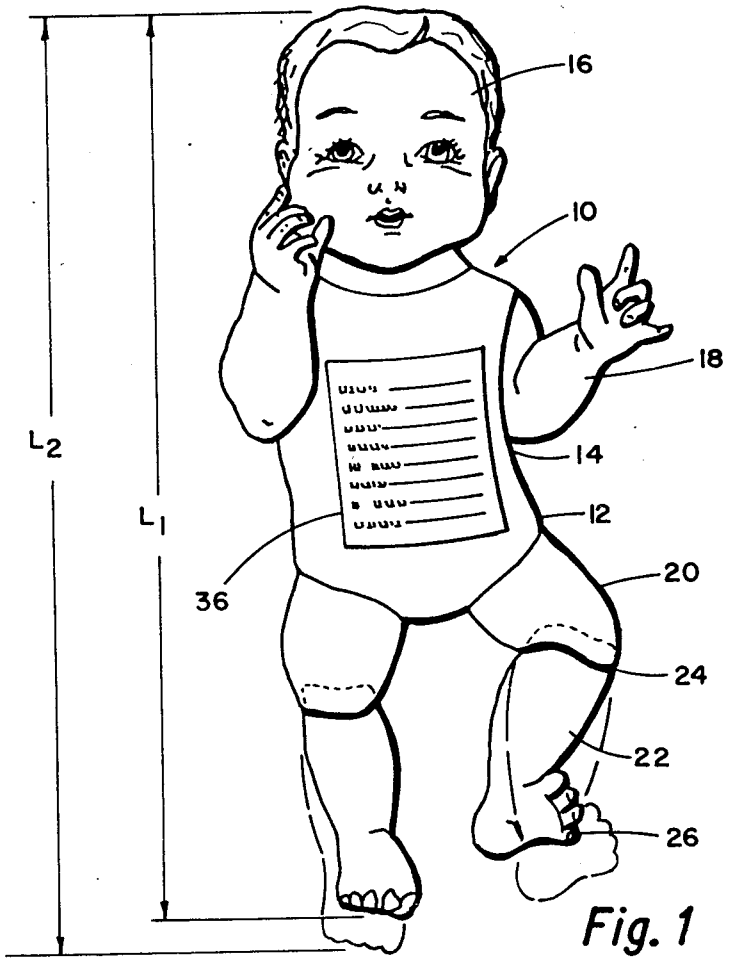
FIG. 1 illustrates a front view of the "twin" doll.

Attention is first directed to FIGS. 1 and 2 which show the doll of my invention and also features which makes it truly a "Twin Doll" TM doll which matches the new born baby for which it is especially tailored. Shown thereon is a doll 10 having a trunk 12 which includes a chest 14. A head 16 is attached to the upper end of the trunk 12. Arms 18 are attached to the trunk and upper legs 20 are also attached to the lower part of the trunk. The upper legs 20 are connected to lower legs 22 by seam 24 at the knee. Foot 26 and foot 27 are connected to the lower legs. The upper leg and the lower leg can be made of fabric material which can be connected by a seam 24. By adjusting the seam 24 which connects the leg 20 and the lower leg 22 one can vary the length of the child such as from $L_1$ to $L_2$. By providing adequate material which makes up the structure of the upper and lower leg sections one can vary the length of the twin doll by up to two to four inches or more, depending upon the manufacturing design. This twin doll is highly personalized and the length of the doll is adjusted and the seam 24 then sewn at a line in the upper leg and lower leg so that the length L of the doll corresponds to the length of the baby for whom the doll is created. No one to my knowledge has ever purposefully adjusted the length of a doll to match the length of the newborn baby.

Attention is next directed to FIG. 2 which shows the main feature which makes this doll truly a "twin" for the newborn babe. I shall now show structure which permits the weight of the doll to be adjusted so that its weight equals the weight of the child when born. This includes a weight 30 which is in a receptacle 31 inside the back portion of the trunk 12. Access is typically obtained through a seam or opening 32 having fasteners 34. As this doll is to serve as a true original "twin" to the newborn child then, after the weight 30 is enclosed, the opening 32 can be closed or sealed in any well known manner such as by stitching. No one to my knowledge has ever created a doll to have a weight which matches the weight of a newborn babe for which the doll is to be a twin.

Attention is directed back to FIG. 1 which shows a display surface 36. This display surface is a surface on which vital statistics are permanently fixed such as by engraving or the like. A very suitable display surface 36 showing the vital statistics is shown in FIG. 5. This includes the name of the child, the date of birth, the color of the hair, the color of the eyes, the weight, the length, the place of birth and the blood type. It will of course be understood that different statistics or categories can be chosen. No one to my knowledge has ever provided a doll with a vital statistic display surface provided on the torso or trunk of a doll.

Figure 7:
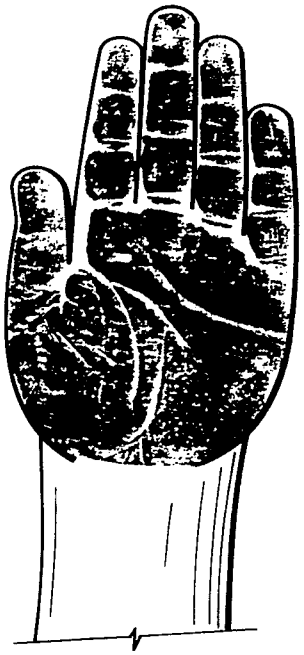
FIG. 6 illustrates the palm of one hand of the doll and
FIG. 7 illustrates the palm of the other hand.
Figure 6:
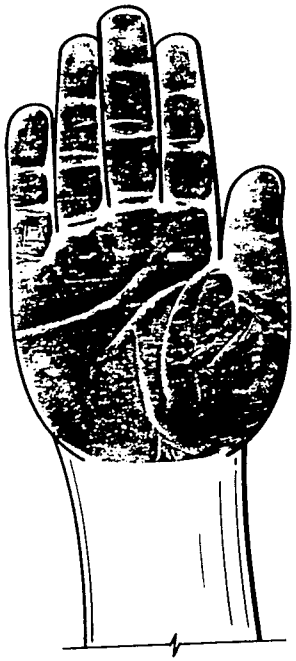

Attention is next directed to FIGS. 3 and 4 which show still another feature of my invention which further personalizes the doll of my invention and makes it even more of a twin to the newborn child. Shown in FIG. 3 is a right foot 26 and in FIG. 4 the left foot 27 which respectively have soles 40 and 42. The footprints of the newborn baby are displayed on the soles 40 and 42. Also shown are FIGS. 6 and 7 which show the palms of the doll with the newborn baby's handprints including finger prints displayed thereon.

I thus have a doll who can truly be considered a twin to the newborn child for which the doll is fabricated. The doll thus has the same weight, the same length and the same footprints and handprints as the newborn child. To the best of my knowledge this is the first truly twin doll. To add to the twinship, I have a display surface 36 upon which the vital statistics of the newborn child can be permanently inscribed.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of making a twin doll for a particular newborn child having vital statistics including name, date of birth, weight, length handprints and footprints which comprises:

constructing a doll having a trunk, a pair of arms attached to said trunk and including means to adjust the length of said arms;

a pair of legs attached to said trunk including means for adjusting the length of said legs;

feet with soles; each of said feet is attached to one of said legs; each of said arms is attached to a hand which has a palm;

permanently adjusting the weight of said trunk so that the weight of said doll equals the weight of said particular newborn child;

permanently adjusting the length of said legs so that the length of the doll equals the length of the particular newborn child;

applying the imprint of the footprint and handprint of the newborn child to the soles of the feet and to the palm of the hand respectively of the doll so that the doll just adjusted is a duplicate of the weight, length and handprints and footprints of the particular newborn child.

2. A method as defined in claim 1 including the step of applying the name and the date of birth of the newborn child to the trunk of said twin doll doll.

3. A method of making a twin doll simulating a particular newborn child in which the newborn child has a name, date of birth, weight, length, footprints and handprints which comprises:

constructing a doll having a trunk, a pair of arms attached to said trunk, a pair of legs attached to said trunk, feet with soles, hands with palms head attached to said trunk; each of said legs attached to one of said feet; each of said hands attached to one of said arms;

fixing the weight of said doll to exactly match that of said particular newborn child;

fixing the length of the doll to exactly match the length of the particular newborn child by permanently adjusting the length of the legs; imprinting the footprints of the particular newborn child to the soles of the feet of the doll.

4. A method of making a twin doll simulating a particular newborn child in which the newborn child has a name, date of birth, weight, length, footprints and handprints which comprises:

constructing a doll having a trunk, a pair of arms attached to said trunk, a pair of legs attached to said trunk, feet with soles, hands with palms and a head attached to said trunk;

fixing the weight of said doll to exactly match that of said particular newborn child;

fixing the length of the doll to exactly match the length of the particular newborn child by permanently adjusting the length of the legs;

imprinting the handprints of the particular newborn child to the palms of the hands of the doll.

* * * * *